US010843462B2

(12) United States Patent
Aoki et al.

(10) Patent No.: US 10,843,462 B2
(45) Date of Patent: Nov. 24, 2020

(54) LIQUID DISCHARGE HEAD SUBSTRATE, LIQUID DISCHARGE HEAD, LIQUID DISCHARGE APPARATUS, METHOD FOR FORMING CONDUCTIVE LAYER, AND METHOD FOR MANUFACTURING LIQUID DISCHARGE HEAD SUBSTRATE

(71) Applicant: CANON KABUSHIKI KAISHA, Tokyo (JP)

(72) Inventors: Takeshi Aoki, Oita (JP); Hisanori Hosaka, Naka-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 25 days.

(21) Appl. No.: 16/016,429

(22) Filed: Jun. 22, 2018

(65) Prior Publication Data

US 2019/0001679 A1 Jan. 3, 2019

(30) Foreign Application Priority Data

Jun. 29, 2017 (JP) ..... 2017-127977

(51) Int. Cl.

| | |
|---|---|
| ***B41J 23/00*** | (2006.01) |
| ***B41J 2/14*** | (2006.01) |
| ***B41J 2/16*** | (2006.01) |
| ***B41J 25/00*** | (2006.01) |
| *B41J 2/165* | (2006.01) |

(52) U.S. Cl.

CPC ..... *B41J 2/14129* (2013.01); *B41J 2/1601* (2013.01); *B41J 2/1603* (2013.01); *B41J 2/1623* (2013.01); *B41J 2/1626* (2013.01); *B41J 2/1628* (2013.01); *B41J 25/006* (2013.01); *B41J 2/16517* (2013.01)

(58) Field of Classification Search

None

See application file for complete search history.

(56) References Cited

U.S. PATENT DOCUMENTS

| | | | | |
|---|---|---|---|---|
| 5,710,583 | A | 1/1998 | Mitani | |
| 2006/0244777 | A1* | 11/2006 | Paasch | B41J 2/0451 347/19 |
| 2007/0196972 | A1* | 8/2007 | Shima | H01L 21/823807 438/197 |
| 2010/0283818 | A1* | 11/2010 | Bruce | B41J 2/14072 347/50 |

(Continued)

FOREIGN PATENT DOCUMENTS

JP 2017-043098 A 3/2017

*Primary Examiner* — Erica S Lin

*Assistant Examiner* — Tracey M McMillion

(74) *Attorney, Agent, or Firm* — Canon U.S.A., Inc. IP Division

(57) ABSTRACT

One embodiment relates to a liquid discharge head substrate including at least one heat generating resistive element, a first insulating layer covering the heat generating resistive element, a conductive layer disposed on the first insulating layer and overlapping the heat generating resistive element with the first insulating layer interposed therebetween in a plan view with respect to an upper surface of the heat generating resistive element, and a second insulating layer covering an edge of the conductive layer. The edge of the conductive layer has a tapered shape.

17 Claims, 11 Drawing Sheets

(56) References Cited

U.S. PATENT DOCUMENTS

| | | | | |
|---|---|---|---|---|
| 2012/0188310 | A1* | 7/2012 | Inoue | B41J 2/1404<br>347/50 |
| 2013/0257995 | A1* | 10/2013 | Sakurai | B41J 2/0455<br>347/56 |
| 2016/0284859 | A1* | 9/2016 | Asami | H01L 29/7869 |

* cited by examiner

LIQUID DISCHARGE HEAD SUBSTRATE, LIQUID DISCHARGE HEAD, LIQUID DISCHARGE APPARATUS, METHOD FOR FORMING CONDUCTIVE LAYER, AND METHOD FOR MANUFACTURING LIQUID DISCHARGE HEAD SUBSTRATE

BACKGROUND

Field of the Disclosure

The present disclosure relates to a liquid discharge head substrate, a liquid discharge head, a liquid discharge apparatus, a method for forming a conductive layer, and a method for manufacturing a liquid discharge head substrate.

Description of the Related Art

There has been known a liquid droplet discharge apparatus having a recording system in which ink is heated by a heat generating resistive element to generate bubbles and ink is discharged onto a recording medium by utilizing this bubble generation to record images, characters, and the like.

Japanese Patent Laid-Open No. 2017-43098 discloses a technique in which a tantalum film is provided on a heat generating resistive element provided on a liquid discharge head substrate, and a silicon carbonitride film having a resistance to ink is provided so as to cover an edge portion of the tantalum film. It is described that the reliability of the liquid droplet discharge head is thereby prevented from lowering with time.

SUMMARY

In an aspect of the present disclosure, a liquid discharge head substrate includes at least one heat generating resistive element, a first insulating layer covering the heat generating resistive element, a conductive layer disposed on the first insulating layer and overlapping the heat generating resistive element with the first insulating layer interposed therebetween in a plan view with respect to an upper surface of the heat generating resistive element, and a second insulating layer covering an edge of the conductive layer. In a cross-section passing through the heat generating resistive element, the second insulating layer, and the conductive layer, the angle formed by a side surface of the edge of the conductive layer and a bottom surface of the conductive layer is an acute angle.

In another aspect of the present disclosure, a method for forming a conductive layer includes the steps of: forming a first film containing iridium; forming a second film containing a metal different from iridium on the first film; etching a part of the second film by isotropical etching in an etching apparatus; and after etching the second film, etching a part of the first film by anisotropical etching.

Further features of the embodiments will become apparent from the following description of exemplary embodiments with reference to the attached drawings.

DESCRIPTION OF THE EMBODIMENTS

In a liquid discharge apparatus, when ink is discharged for a long time, depending on a component contained in the ink, the surface material of the liquid discharge head substrate directly contacting with the ink, for example, an insulating layer, is dissolved in the ink. When the ink reaches the heat generating resistive element, the heat generating resistive element is corroded by the ink and disconnection may occur.

Figure 11:
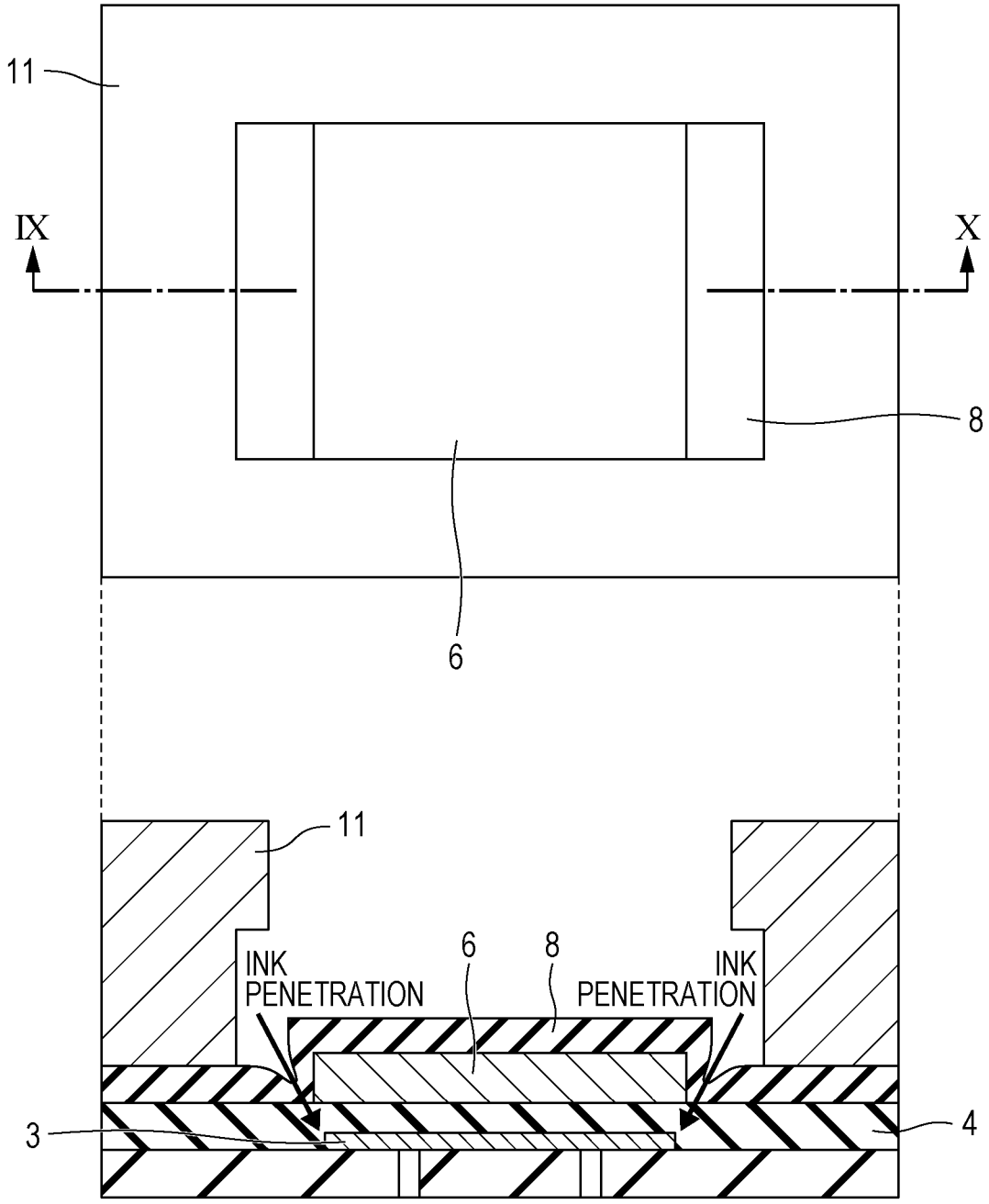
FIG. 11 is a schematic view of an example of a part of a liquid discharge head substrate.

FIG. 11 shows a schematic view of a liquid discharge head for explaining the problem of the liquid discharge head substrate. In the liquid discharge head of FIG. 11, at the edge portion of the protective layer 6 made of a tantalum film, since the angle formed by the side surface and the bottom surface is vertical, the coatability of the silicon carbonitride film 8 is insufficient at the edge portion of the protective layer 6. In this case, the ink penetrates through a portion where the coatability of the silicon carbonitride film 8 is insufficient, the insulating layer 4 under the silicon carbonitride film 8 is dissolved by the ink, and corrosion of the heat generating resistive element 3 and disconnection may occur.

In addition, when the protective layer is a conductive layer containing iridium, it is difficult to etch the conductive layer into a desired shape, so that the coatability of the film formed on the protective layer with respect to the protective layer is likely to be insufficient.

According to some embodiments according to the present disclosure, it is possible to improve the coatability of the film covering the edge portion with respect to the protective layer by tapering the edge portion of the conductive layer that is the protective layer of the heat generating resistive element. Further, the edge portion of a conductive layer in which a film containing iridium and a film containing another metal are stacked can be tapered.

Hereinafter, embodiments will be described with reference to the drawings. Embodiments according to the present disclosure are not limited to embodiments described below. For example, some configurations of any one of the following embodiments may be added to other embodiments, and some configurations of other embodiments may be replaced.

It is to be noted that each drawing is described for the purpose of explaining the structure or configuration, and the dimensions of each member shown in the drawings may be different from the actual dimensions of the constructional elements. In each drawing, the same reference numeral is attached to the same member or the same constructional element, and the description of the overlapping contents will be omitted below.

Embodiment 1

A liquid discharge head substrate and a manufacturing method thereof according to an embodiment will be described with reference to FIGS. 1 to 4. In FIGS. 1 to 4, the same reference numerals are used for parts having the same configuration and function.

Figure 1:
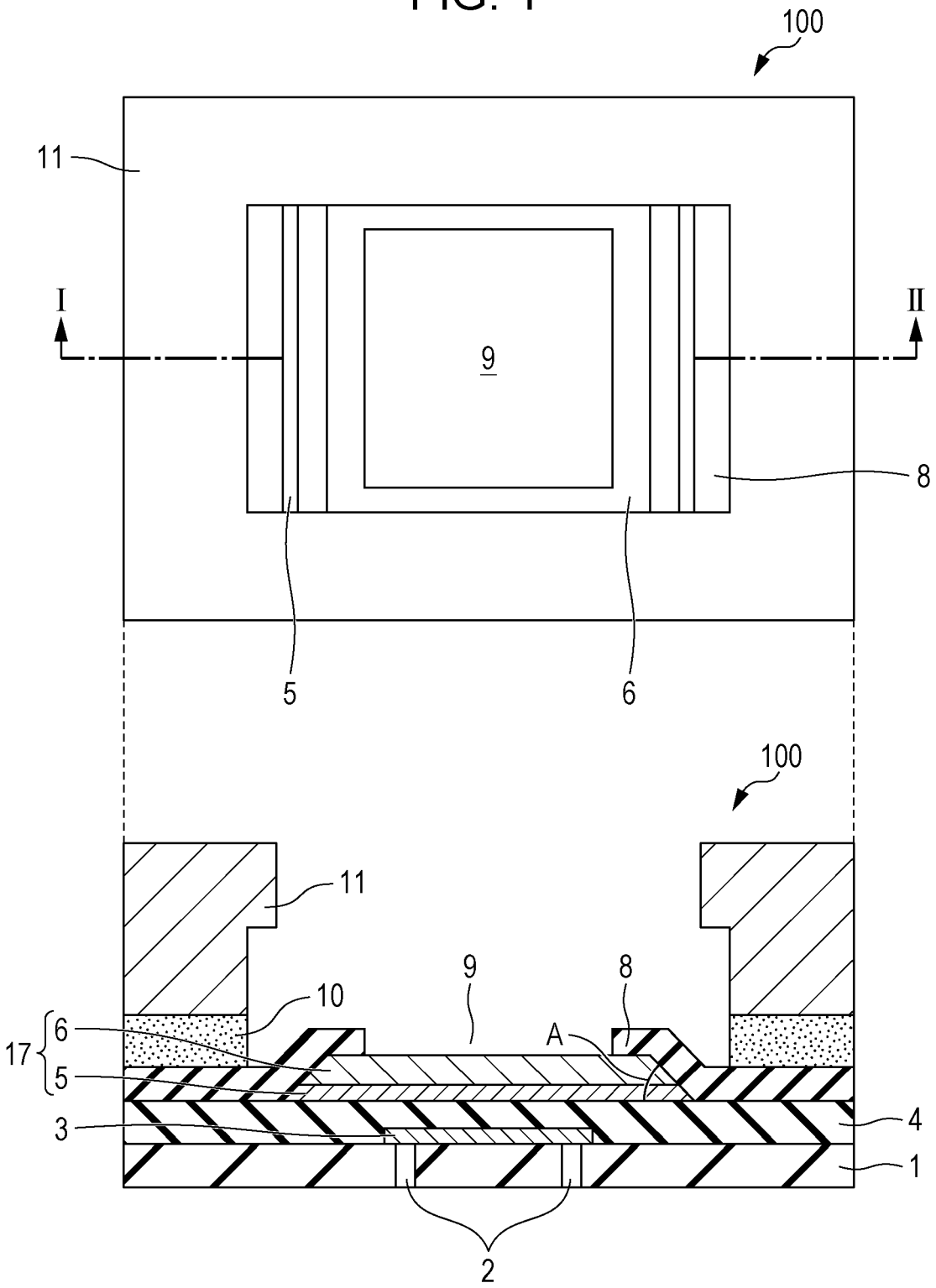
FIG. 1 is a schematic diagram of an example of a part of a liquid discharge head substrate according to Embodiment 1.

FIG. 1 shows a schematic plan view and a schematic cross-sectional view of an example of a part of a liquid discharge head substrate 100 according to this embodiment.

The liquid discharge head substrate 100 has a heat generating resistive element 3, an insulating layer 4 covering the heat generating resistive element 3, a conductive layer 17 overlapping the heat generating resistive element 3 in a plan view with the insulating layer 4 interposed therebetween, and an insulating layer 8 covering the edge portion of the conductive layer 17. The insulating layer 8 functions as a protective film, and a nozzle member 11 having an opening at a position corresponding to the heat generating resistive element 3 is disposed on the insulating layer 8 with an adhesive layer 10 interposed therebetween. The opening of the nozzle member 11 can be used as a liquid chamber or a supply port. The plan view here means a plan view with respect to the upper surface of the heat generating resistive element 3. Another insulating film may be interposed between the heat generating resistive element 3, the insulating layer 4, the conductive layer 17, and the insulating layer 8.

The liquid discharge head substrate 100 has a plurality of liquid discharge elements arranged in one row or a plurality of rows, and the liquid discharge elements have a heat generating resistive element 3 and a conductive layer 17. The heat generating resistive element 3 is, for example, a heater composed of a conductive layer, and generates a thermal energy for discharging a liquid such as ink by flowing a current. The insulating layer 1 on which the heat generating resistive element 3 is disposed has an opening, and a plug 2 that supplies electric power for driving the heat generating resistive element 3 is disposed in the opening.

The conductive layer 17 has a function of protecting the heat generating resistive element 3 from damage of cavitation generated when bubbles generated in the liquid heated by the heat generating resistive element 3 burst. The liquid discharge head substrate 100 of FIG. 1 shows an example of a film in which a conductive layer 17 has a conductive layer 5 disposed on an insulating layer 4 and a conductive layer 6 disposed on the conductive layer 5, and the conductive layer 5 and the conductive layer 6 contain different metals. For example, the conductive layer 5 can be an iridium film and the conductive layer 6 can be a tantalum film.

FIG. 1 is a schematic view showing a cross-section of a part of the liquid discharge head substrate 100 in a cross-section passing through the heat generating resistive element 3, the insulating layer 4, and the conductive layer 17, and in this cross-section, the edge portion of the conductive layer 17 has a tapered shape, that is, the angle A formed by the side surface and the bottom surface of the conductive layer 17 is an acute angle. Though not shown, a through hole for supplying liquid is formed beside the heat generating resistive element 3 of the substrate of the liquid discharge head substrate 100.

The edge portion of the conductive layer 17 and the insulating layer 4 are covered by the insulating layer 8. The insulating layer 8 serving as a protective film exhibits a chemically stable characteristic with respect to ink, and has a function of preventing the ink from corroding the heat generating resistive element 3 and causing disconnection. For example, a silicon carbide film, a silicon carbonitride film, a silicon nitride film, or the like can be used as the insulating layer 8. Here, since the edge portion of the conductive layer 17 has a tapered shape, the coatability of the insulating layer 8 with respect to the conductive layer 17 is good, and it is possible to suppress the penetration of ink through the edge portion of the conductive layer 17.

In order to suppress the loss of thermal energy transferred from the heat generating resistive element 3 to the ink, the insulating layer 8 is removed in at least a part of the region overlapping the heat generating resistive element 3 in a plan view, that is, in the bubble generating region 9, and has an opening. In this case, a part of the conductive layer 17 that is not covered by the insulating layer 8 is in contact with a liquid such as ink, but since the conductive layer 6 that is a tantalum layer is chemically stable with respect to the ink, there is no problem even without the insulating layer 8. The conductive layer 5 that is an iridium layer is more stable with respect to ink than the tantalum layer. Therefore, by using the iridium layer in the conductive layer 17 functioning as an anti-cavitation film, it is possible to obtain a liquid discharge head substrate with high reliability.

A nozzle member 11 is formed on the insulating layer 8 with an adhesive layer 10 interposed therebetween. The adhesive layer 10 functions as a bonding layer between the insulating layer 8 and the nozzle member 11, and for example, an organic material can be used. The nozzle member 11 has an opening serving as a liquid discharge port in a region facing the heat generating resistive element 3. A part of the nozzle member 11 that is bonded to the insulating layer 8 surrounds the conductive layer 17 and does not overlap with the conductive layer 17 in a plan view with respect to the upper surface of the heat generating resistive element 3.

If the edge portion of the conductive layer 17 is located outside the part where the nozzle member 11 is bonded to the insulating layer 8 in plan view, there is a low possibility that a part of the insulating layer 8 that has low coatability due to the edge portion of the conductive layer 17 is exposed to ink or the like. Therefore, there is a low possibility that the liquid will reach the insulating layer 4 or the heat generating resistive element 3 owing to the edge portion of the conductive layer 17.

However, as in the liquid discharge head substrate shown in FIG. 1, a part of the nozzle member 11 that is bonded to the insulating layer 8 may surround the conductive layer 17 in a plan view with respect to the upper surface of the heat generating resistive element 3. In other words, the edge portion of the conductive layer 17 may be located inside the opening of the nozzle member 11 defined by the part of the nozzle member 11 that is bonded to the insulating layer 8. In this case, a liquid such as ink often comes into contact with a part of the insulating layer 8 where that has low coatability due to the edge portion of the conductive layer 17.

Therefore, by tapering the edge portion of the conductive layer 17 and improving the coatability of the insulating layer 8, it is possible to suppress or prevent the liquid from coming into contact with the insulating layer 4 and the heat generating resistive element 3 even if the liquid is in contact with a region of the insulating layer 8 corresponding to the edge portion of the conductive layer 17. Therefore, corrosion of the heat generating resistive element 3 and disconnection can be reduced and prevented, and the effect of improving the reliability of the liquid discharge head substrate 100 is remarkably obtained.

Even when the edge portion of the conductive layer 17 is located outside the inner wall of the part where the nozzle member 11 is bonded to the insulating layer 8, there is a possibility that a liquid such as ink oozes between the adhesive layer 10 and the nozzle member 11 or between the adhesive layer 10 and the insulating layer 8. Therefore, by tapering the edge portion of the conductive layer 17 covered by the insulating layer 8, the same effect can be obtained also in such a case.

Figure 2A:
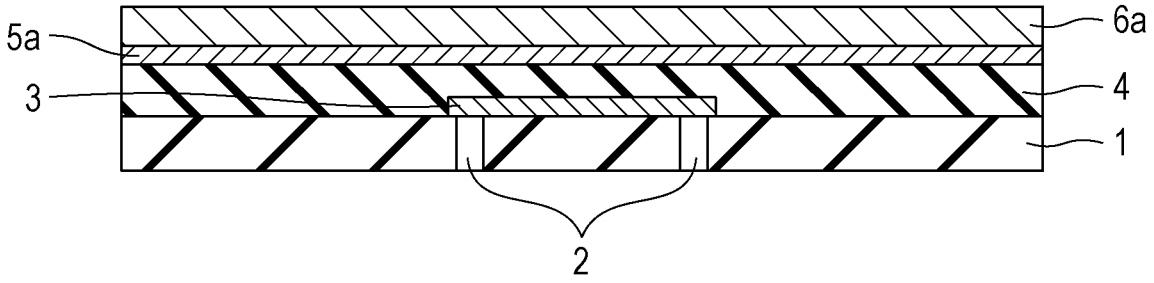
FIGS. 2A to 2C are views illustrating a method for manufacturing a part of the liquid discharge head substrate according to Embodiment 1.

Next, the manufacturing method of this embodiment will be described with reference to FIGS. 2A to 3C. As shown in FIG. 2A, a conductive film that is to become the conductive layer 17 is formed on the insulating layer 4 covering the heat generating resistive element 3. An example in which a conductive film 5*a* and a conductive film 6*a* stacked on the conductive film 5*a* are formed as conductive films will be described. A metal film can be used as the conductive layers 5*a* and 6*a*. For example, the conductive films 5*a* and 6*a* can be formed by stacking an iridium film as the conductive film 5*a* and a tantalum film as the conductive film 6*a* sequentially by a sputtering method or the like.

Figure 2B:
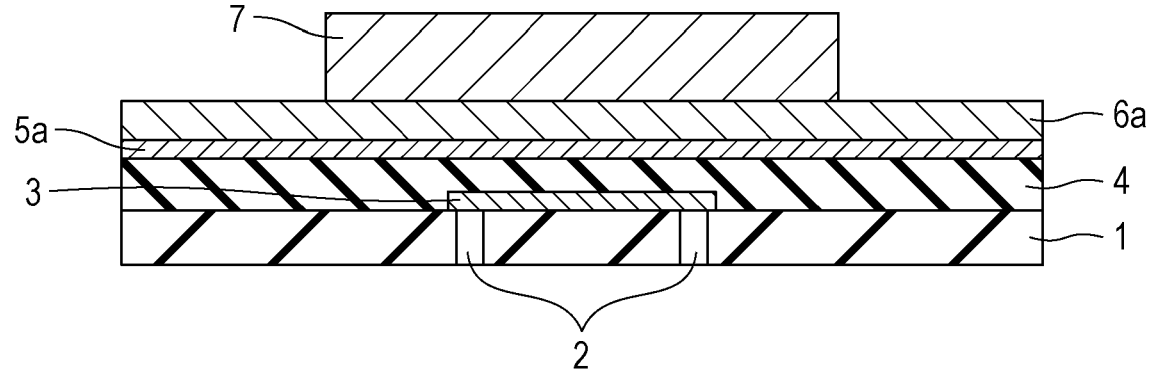

Next, as shown in FIG. 2B, a photoresist film is formed on the conductive film 6*a* by a coating method, and exposure and development are performed to form a mask 7.

Figure 2C:
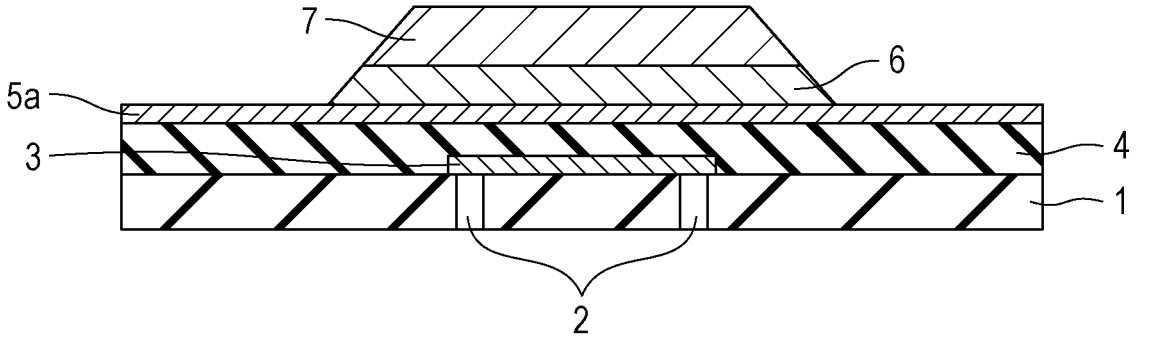

As shown in FIG. 2C, the conductive film 6*a* that is a tantalum film is isotropically etched to the surface of the conductive film 5*a* that is an iridium film by a dry etching method using the mask 7. As a result, the edge portion of the conductive layer 6 can be tapered. The isotropic etching is etching performed under conditions where etching proceeds in all directions in a part where there is no mask. It can be said that the isotropy is high when the etching rates in respective directions are equal to each other.

Specifically, in the reaction chamber in the etching apparatus, a processed substrate to be processed is disposed between the upper electrode and the lower electrode. At this time, the processed substrate is disposed such that the conductive film 5*a* is disposed on the lower electrode side and the conductive film 6*a* is disposed on the upper electrode side. Next, processing gases of $Cl_2$ gas and $BCl_3$ gas are introduced into the reaction chamber and are controlled to a desired pressure. After the pressure in the reaction chamber is stabilized, etching is performed by applying high-frequency power to the upper electrode located on the conductive film 6*a* side and the lower electrode located on the conductive film 5*a* side where the processed substrate is disposed.

Here, by applying high-frequency power to the upper electrode, radicals and ions are generated in the plasma. Since the electrically neutral radicals are not affected by the electric field, the radicals diffuse in the vapor phase, adheres to the processed substrate, and chemically reacts with the film on the surface of the processed substrate, and etching is performed isotropically. Increasing the amount of high-frequency power applied to the upper electrode increases the amount of radical generation, so by increasing the high-frequency power applied to the upper electrode, isotropic etching becomes dominant and isotropic etching can be suitably performed.

Therefore, in order to taper the edge portion of the conductive layer 6 as shown in FIG. 2C, the amount of high-frequency power applied to the upper electrode is made larger than the amount of high-frequency power applied to the lower electrode. As a result, isotropic etching can be effectively performed. By isotropically etching the conductive layer 6*a* that is a tantalum film, the edge portion of the conductive film 6*a* is etched from the upper surface and the side surface, so that the edge portion of the conductive layer 6 can be tapered.

When iridium is etched, the reaction product generated by reaction with the etching gas has a low saturated vapor pressure and may be difficult to become gas. For example, when iridium is etched in a chlorine atmosphere, iridium chloride is produced as a reaction product. Since iridium chloride has a low saturation vapor pressure, the iridium chloride generated as a reaction product continues to exist on the iridium film and inhibits the etching of the iridium film.

Here, as the etching of the conductive film 6*a* that is a tantalum film proceeds, the conductive film 5*a* that is an iridium film starts to be exposed. Under this condition, chlorine radicals react with the iridium film to form iridium chloride. Since iridium chloride is chemically stable, it is formed on the surface of the conductive film 5*a* containing iridium and the reaction does not proceed any more. Even if a part of the etching gas is ionized, the high-frequency power applied to the lower electrode is smaller than the high-frequency power applied to the upper electrode, and ions hardly strike the processed substrate (etching object) physically.

Therefore, the conductive film 5*a* is hardly etched, and only the conductive film 6*a* is isotropically etched from the edge portion. As a result, the edge portion of the conductive layer 6 can be tapered.

Figure 3A:
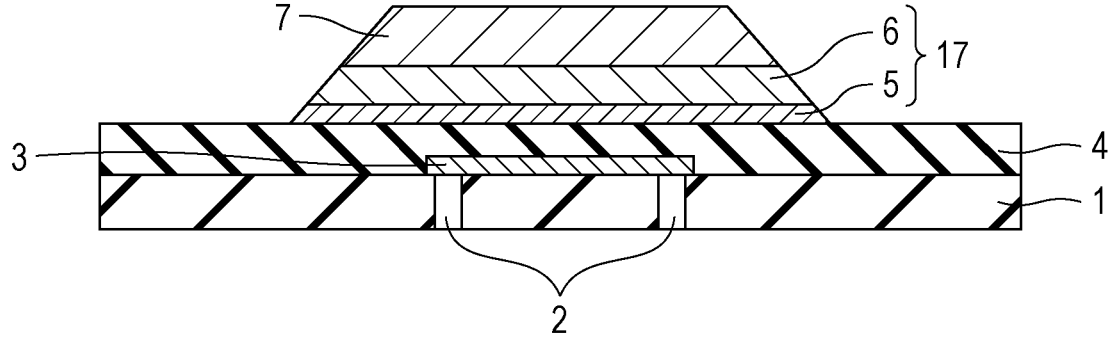
FIGS. 3A to 3C are views illustrating a method for manufacturing a part of the liquid discharge head substrate according to Embodiment 1.

Next, as shown in FIG. 3A, the conductive film 5*a* that is an iridium film is anisotropically etched by dry etching using the mask 7 and the conductive layer 6 until the insulating layer 4 is exposed. In this embodiment, processing gases of $Cl_2$ gas and Ar gas are introduced into a reaction chamber in which etching is performed, and are controlled to a desired pressure. After the pressure in the reaction chamber is stabilized, high-frequency power is applied to the upper electrode and the lower electrode to generate plasma, and etching is performed. By making the amount of high-frequency power applied to the lower electrode larger than the amount of high-frequency power applied to the upper electrode, anisotropic etching can be suitably performed. The anisotropic etching is etching in which etching proceeds in one direction (etching in one direction dominates over etching in the other directions).

In the etching apparatus, when high-frequency power is applied to the lower electrode, a negative self-bias is generated on the lower electrode. Since charged ions are affected by an electric field, ions are accelerated in a direction perpendicular to the processed substrate by the negative self-bias generated on the lower electrode, and ions collide with the surface of the processed substrate (etching object). Therefore, the surface of the processed substrate is physically scraped from one direction, and anisotropic etching is performed. When the amount of high-frequency power applied to the lower electrode is increased, the energy accelerating ions increases. Therefore, by increasing the high-frequency power applied to the lower electrode, anisotropic etching can be suitably performed.

As described above, the reaction product inhibits etching of an iridium film, and therefore even if chemical etching for the purpose of isotropic etching is performed, etching is difficult. Therefore, it is difficult to taper the edge portion of the conductive layer 5. So, in this embodiment, the conductive film 5*a* that is an iridium film is etched not by isotropic etching but by anisotropic etching. As described above, in the anisotropic etching, etching is performed not by chemically reacting the etching gas and iridium but physically by ions of gas species for etching (for example, argon). Therefore, the conductive film 5*a* that is an iridium film can be etched.

At this time, the conductive layer 6 and the mask 7 disposed on the conductive film 5*a* are also etched. Since the mask 7 and the conductive layer 6 have a tapered shape at the edge portions, when ions are bombarded in the film thickness direction by anisotropic etching, the edge portions recede in a direction in which the area in plan view decreases. As a result, a part of the conductive film 5*a* that is covered by the edge portion of the conductive layer 6 is exposed and etched. In this manner, as the edge portions of the mask 7 and the conductive layer 6 recede, the conductive film 5 that is an iridium film is exposed and the area to be etched increases, and this part has a tapered shape. Therefore, the edge portion of the conductive layer 5 can have a tapered shape by inheriting the tapered shape of the edge portion of the conductive layer 6. In this way, the conductive layer 17 having a tapered edge portion can be formed.

Figure 3B:
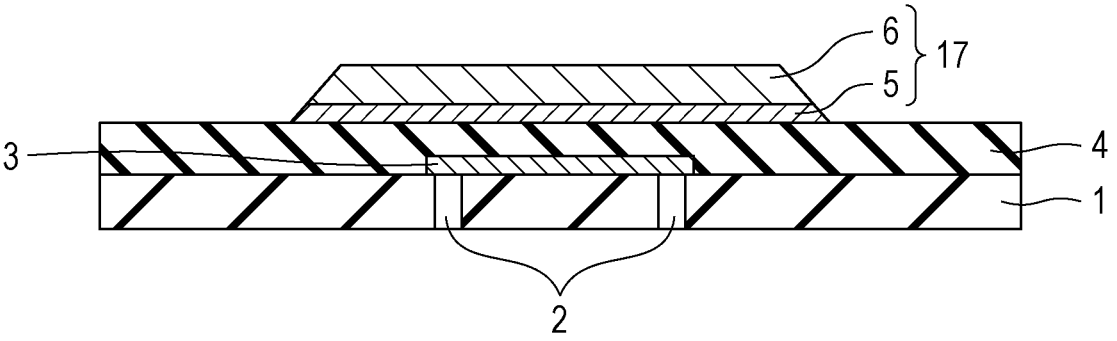
Figure 3C:
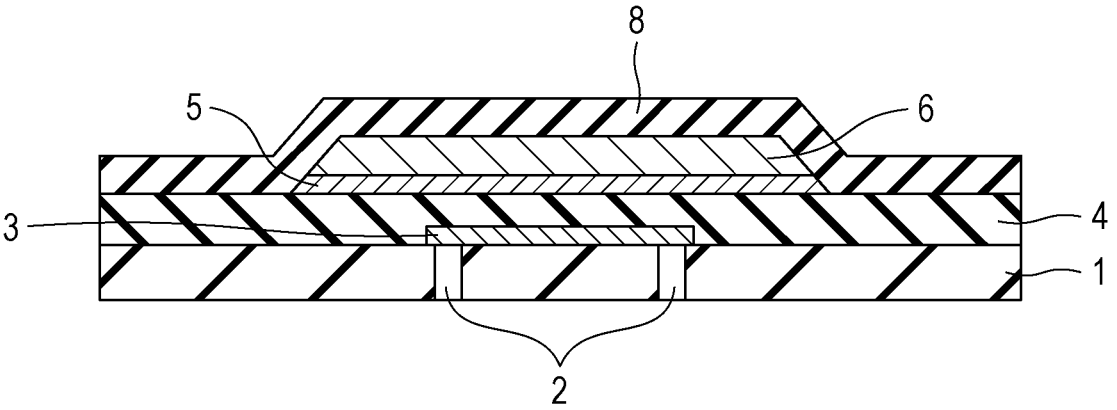

Next, as shown in FIG. 3B, the mask 7 is removed by asking and a chemical solution. After removing the mask 7, as shown in FIG. 3C, an insulating layer 8, for example, a silicon carbide film is formed by the CVD method. Here, a silicon carbide film is used, but a silicon carbonitride film may be used. Since the edge portion of the conductive layer 17 including the conductive layer 5 and the conductive layer 6 has a tapered shape, the coatability of the insulating layer 8 with respect to the edge portion of the conductive layer 17 is favorable.

Next, in the bubble generating region 9, the insulating layer 8 is removed to expose the conductive layer 6, and as shown in FIG. 1, the nozzle member 11 is bonded to the insulating layer 8 with the adhesive layer 10 interposed therebetween to form a liquid discharge head.

In this embodiment, an example of a layer containing tantalum is shown as the conductive layer 6, but the conductive layer 6 is not limited thereto. A layer containing a metal such that the reaction product between it and the etching gas species has a saturated vapor pressure higher than the saturated vapor pressure of the reaction product between iridium and the gas species can be used as the conductive layer 6. For example, a layer containing any of tungsten, aluminum, and titanium can be used.

Figure 4:
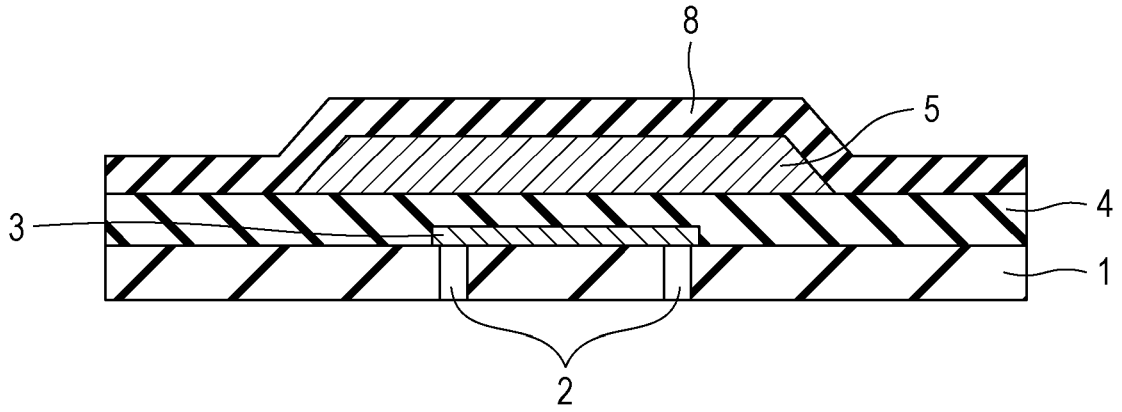
FIG. 4 is a schematic diagram of an example of a part of the liquid discharge head substrate according to Embodiment 1.

Although an example in which the conductive layer 17 includes the conductive layer 5 and the conductive layer 6 has been described, the conductive layer 17 may be a single layer as illustrated in FIG. 4. For example, by using an iridium film, it is possible to obtain a liquid discharge head substrate that is stable toward ink or the like and has high reliability. In the case where the conductive layer 17 is formed of one iridium layer, the edge portion of the conductive layer 17 can be tapered by disposing a mask having a tapered edge portion on the iridium film and performing anisotropic etching. Thereby, the coatability of the insulating layer 8 with respect to the conductive layer 17 can be improved.

Embodiment 2

This embodiment will be described with reference to FIG. 5. Description of parts and effects having the same configuration and function as in Embodiment 1 will be omitted. This embodiment differs from Embodiment 1 in that the conductive layer 6 has an opening.

Figure 5:
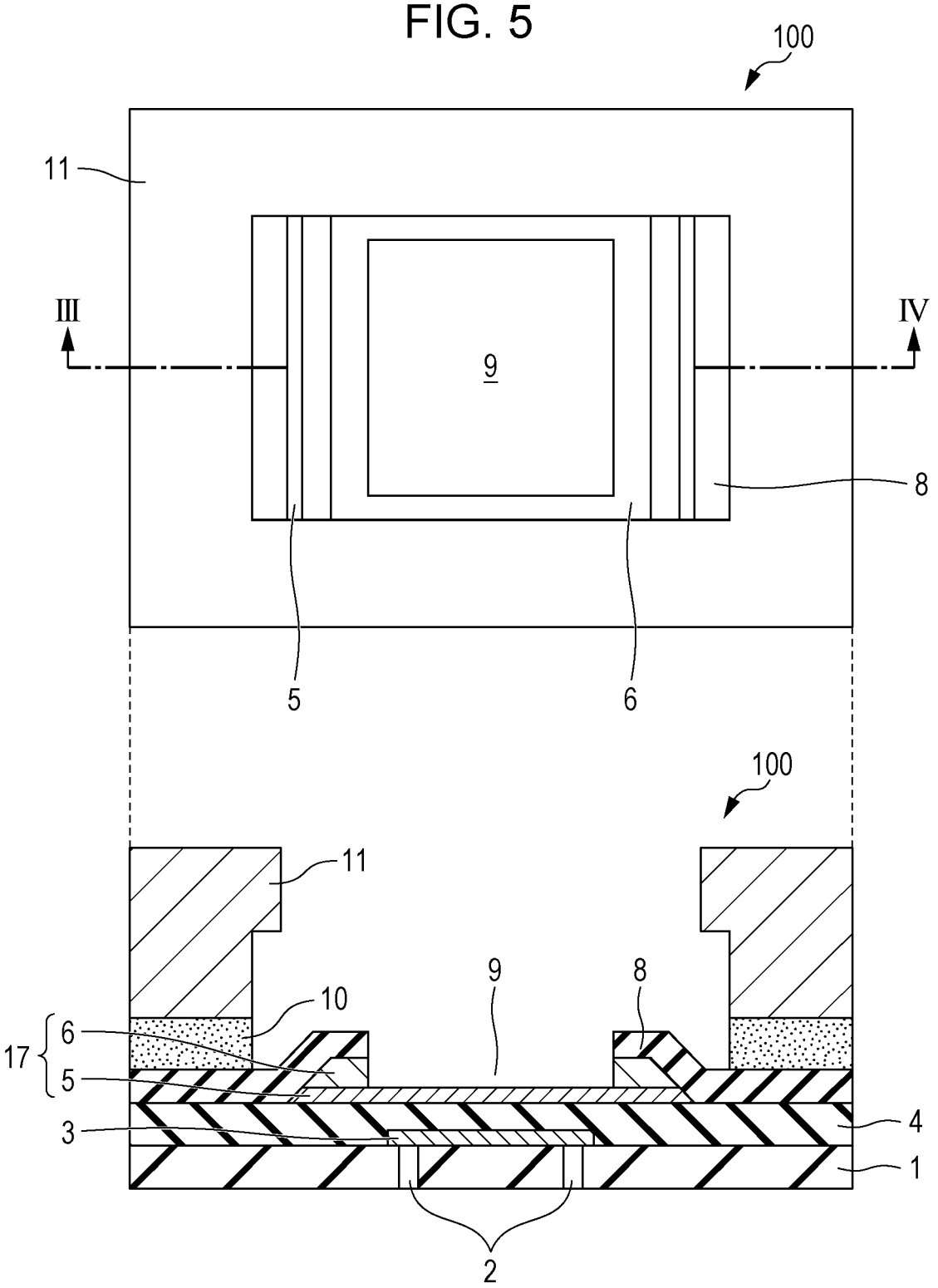
FIG. 5 is a schematic diagram of an example of a part of a liquid discharge head substrate according to Embodiment 2.

In FIG. 5, the insulating layer 8 covers the edge portion of the conductive layer 17 including the conductive layer 5 that is a layer containing iridium and the conductive layer 6 that is a layer of a metal different from iridium, and the insulating layer 8 has an opening in the bubble generating region 9. The bubble generating region 9 is a region overlapping with the heat generating resistive element 3 in a plan view with respect to the upper surface of the heat generating resistive element 3. In the opening of the insulating layer 8 overlapping with the bubble generating region 9, the conductive layer 6 is removed, and the conductive film 5 which is, for example, an iridium layer is exposed. By exposing the conductive layer 5 in the bubble generating region 9, the efficiency of transferring the thermal energy generated in the heat generating resistive element 3 to the ink can be improved. Although not shown, the conductive layer 6 may function as wiring. Therefore, in a region other than the part overlapping with the opening of the insulating layer 8 in plan view, the conductive layer 6 may not be removed and may be stacked on the conductive layer 5.

A nozzle member 11 is disposed on the insulating layer 8 with an adhesive layer 10 interposed therebetween. For example, an organic layer can be used as the adhesive layer 10.

The liquid discharge head substrate 100 shown in FIG. 5 can be manufactured through the same steps as those of the liquid discharge head substrate 100 of Embodiment 1 except for the following steps. In the liquid discharge head substrate according to this embodiment, when the insulating layer 8 in the bubble generating region 9 is removed and the opening is formed, the conductive layer 6 in the opening is also removed at the same time to expose the conductive layer 5. Alternatively, after removal of the insulating layer 8 in the bubble generating region 9, the conductive layer 6 in the insulating layer 8 may be removed by changing conditions to suit the removal of the conductive layer 6.

Also in the liquid discharge head substrate 100 described in this embodiment, since the edge portion of the conductive layer 17 has a tapered shape, the coatability of the insulating layer 8 with respect to the edge portion of the conductive layer 17 can be improved. Therefore, the liquid discharge head substrate 100 with improved reliability can be obtained.

Embodiment 3

This embodiment will be described with reference to FIGS. 6, 7A to 8 C. Also in this embodiment, description of parts, effects, manufacturing methods, and the like having the same configuration and function as in Embodiment 1 or 2 will be omitted. This embodiment differs from Embodiment 1 in that the conductive layer 17 of Embodiment 1 is a stack of two layers of a layer containing iridium and a layer of a metal different from iridium, or a single layer, whereas in this embodiment, the conductive layer 17 has three conductive layers.

Figure 6:
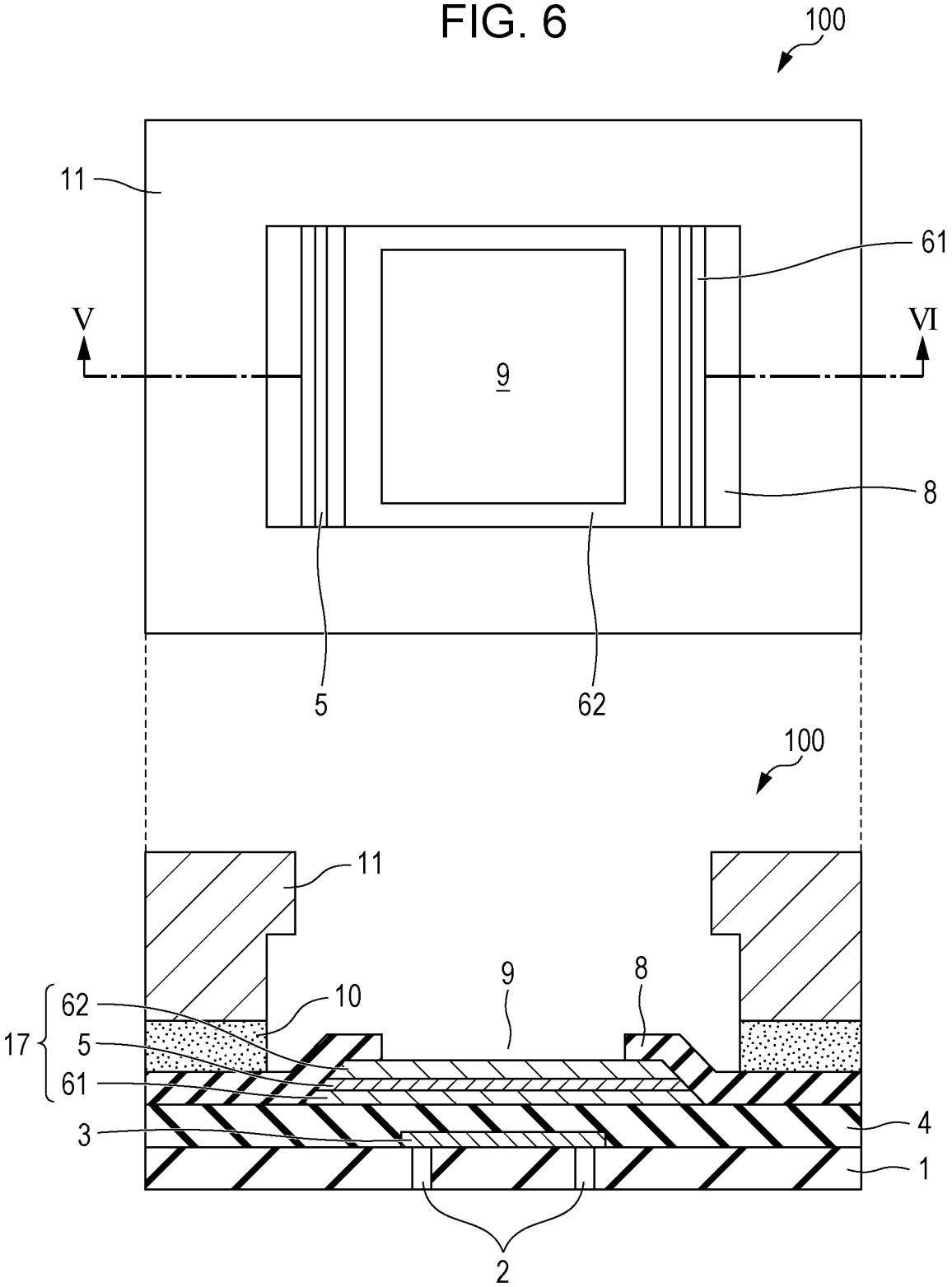
FIG. 6 is a schematic cross-sectional view of an example of a part of a liquid discharge head substrate according to Embodiment 3.

In the liquid discharge head substrate 100 shown in FIG. 6, in order to protect the heat generating resistive element 3, the conductive layer 17 having three layers of the conductive layer 61, the conductive layer 5, and the conductive layer 62 is disposed on the heat generating resistive element 3 with the insulating layer 4 interposed therebetween. The conductive layer 5 is a layer containing iridium as in Embodiment 1, and for example, an iridium layer can be used. A film containing a metal different from iridium can be used as the conductive layer 61 and the conductive layer 62. For example, the conductive layers 61 and 62 can be tantalum layers. The edge portion of the conductive layer 17 has a tapered shape as in Embodiments 1 and 2, and the angle formed by the side surface and the bottom surface of the edge portion of the conductive layer 17 is an acute angle.

The edge portion of the conductive layer 17 having the conductive layer 61, the conductive layer 5, and the conductive layer 62 is covered by the insulating layer 8, and since the edge portion of the conductive layer 17 has a tapered shape, the coatability of the insulating layer 8 with respect to the edge portion of the conductive layer 17 can be improved. Therefore, penetration of ink through a part of the insulating layer 8 corresponding to the edge portion of the conductive layer 17 can be greatly suppressed.

Figure 7A:
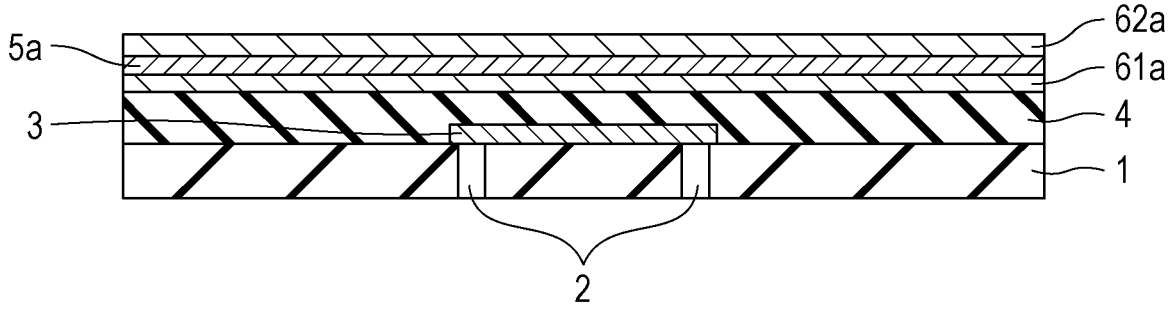
FIGS. 7A to 7C are views illustrating a method for manufacturing a part of the liquid discharge head substrate according to Embodiment 3.
Figure 7B:
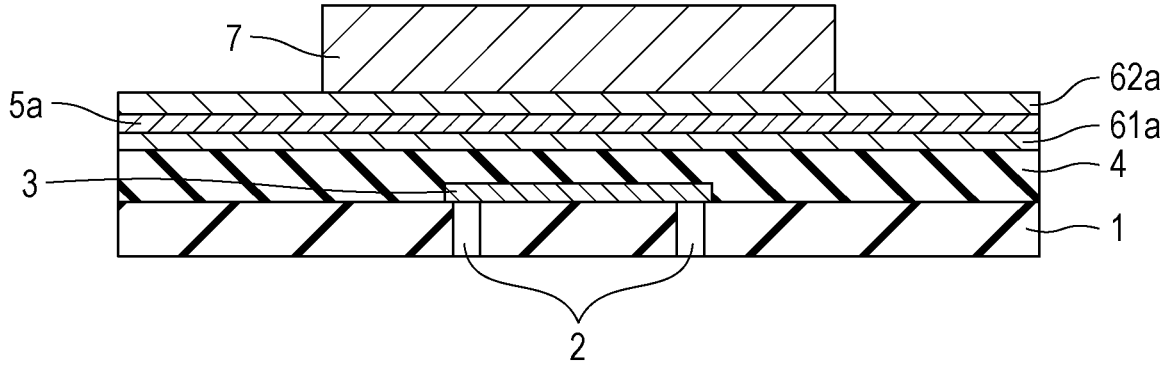

The manufacturing method of this embodiment will be described with reference to FIGS. 7A to 8C. As shown in FIG. 7A, a conductive film 61*a* that is a tantalum film, a conductive film 5*a* that is an iridium film, and a conductive film 62*a* that is a tantalum film are formed in this order on the insulating layer 4 covering the heat generating resistive element 3 by a sputtering method or the like. Next, as shown in FIG. 7B, a photoresist film is formed on the conductive film 62*a* by a coating method, and a mask 7 is formed through exposure and development processing.

Figure 7C:
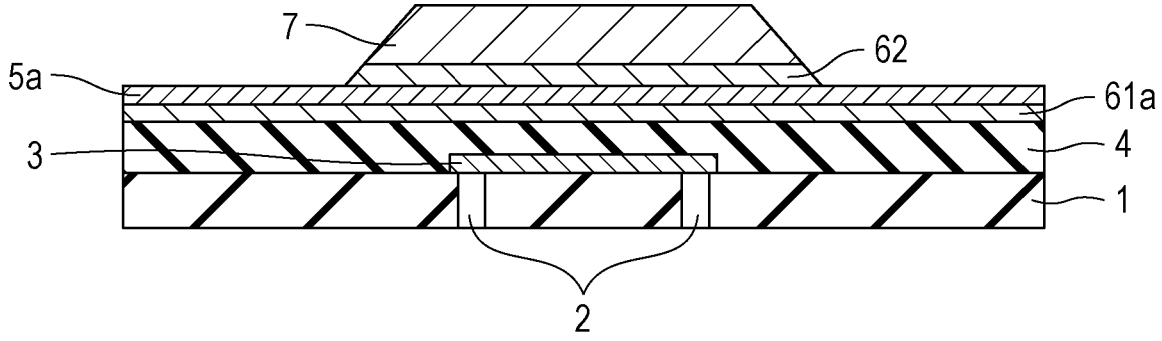

After forming the mask 7, as shown in FIG. 7C, the conductive film 62*a* is isotropically etched to the surface of the conductive film 5*a* using the mask 7 by a dry etching method. Thus, the edge portion of the conductive layer 62 can be tapered.

Specifically, in the reaction chamber in which etching is performed, a processed substrate to be processed is arranged between the upper electrode and the lower electrode. Next, processing gases of $Cl_2$ gas and $BCl_3$ gas are introduced into the reaction chamber and are controlled to a desired pressure. After the pressure in the reaction chamber is stabilized, etching is performed by applying high-frequency power to the upper electrode located on the conductive film 62*a* side and the lower electrode located on the conductive film 61*a* side where the processed substrate is disposed. As in Embodiment 1, by making the amount of high-frequency power applied to the upper electrode larger than the amount of high-frequency power applied to the lower electrode, isotropic etching is performed, so that the edge portion of the conductive layer 62 can be tapered. As in Embodiment 1, even when the etching of the conductive film 62*a* proceeds and the surface of the conductive film 5*a* that is an iridium film is exposed, the iridium film is hardly etched under this condition.

Figure 8A:
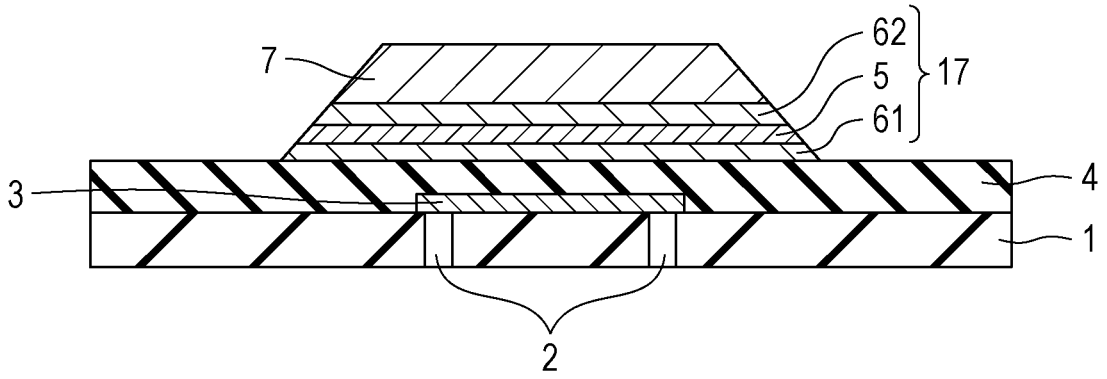
FIGS. 8A to 8C are views illustrating a method for manufacturing a part of the liquid discharge head substrate according to Embodiment 3.
Figure 8B:
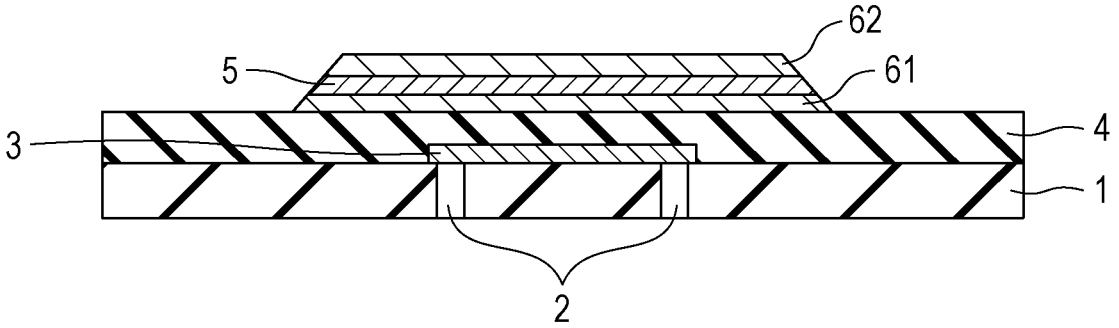

Next, as shown in FIG. 8A, the conductive film 5*a* containing iridium and the conductive film 61*a* containing a metal different from iridium are anisotropically etched by dry etching using the conductive layer 62 and the mask 7 until the insulating layer 4 is exposed. In this embodiment, processing gases of $Cl_2$ gas and Ar gas are introduced into a reaction chamber in which etching is performed, and are controlled to a desired pressure. After the pressure in the reaction chamber is stabilized, high-frequency power is applied to the upper electrode and the lower electrode to generate plasma, and etching is performed. By making the amount of high-frequency power applied to the lower electrode larger than the amount of high-frequency power applied to the upper electrode, anisotropic etching can be suitably performed.

As described in Embodiment 1, the edge portions of the mask 7 and the conductive layer 62 recede in the direction perpendicular to the film thickness direction of the conductive layer 17 by anisotropic etching, and the exposed conductive film 5*a* and the exposed part of the conductive film 61*a* are etched. Thus, the edge portions of the conductive layers 5 and 61 inherit the tapered shape of the edge portion of the conductive layer 62, and the conductive layer 5 and the conductive layer 61 each having a tapered edge portion can be obtained.

Depending on the material of the conductive film 61*a*, for example, when the conductive film 61*a* is formed of the same metal film as the conductive film 62*a*, the conductive film 61*a* can be etched by isotropic etching. However, when the conductive film 61*a* is etched by isotropic etching, the conductive film 61*a* and the conductive layer 62 are etched while the conductive layer 5 that is a film containing iridium is hardly etched. Therefore, a step is formed at the edge portions of the conductive layer 62 and the conductive layer 5. Therefore, in order to suppress formation of a step on the side surface of the conductive layer 17, the etching of the conductive film 61*a* is preferably performed by anisotropic etching.

Figure 8C:
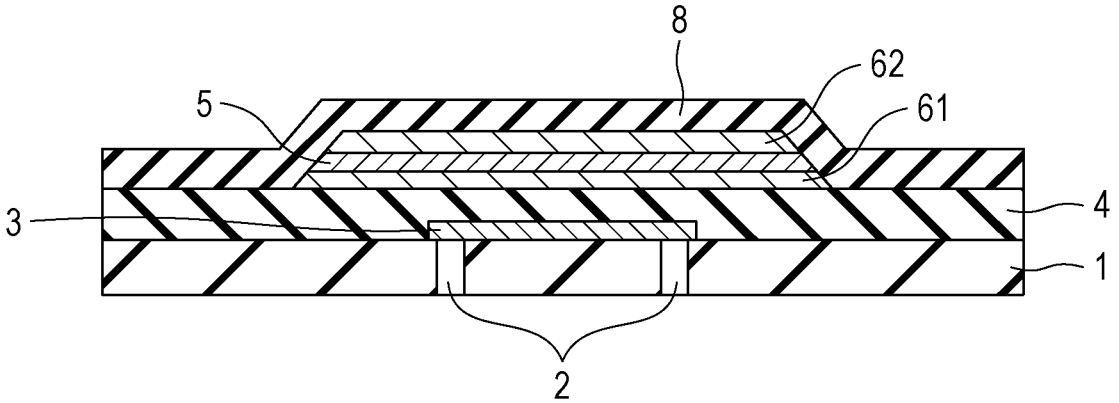
Figure 9:
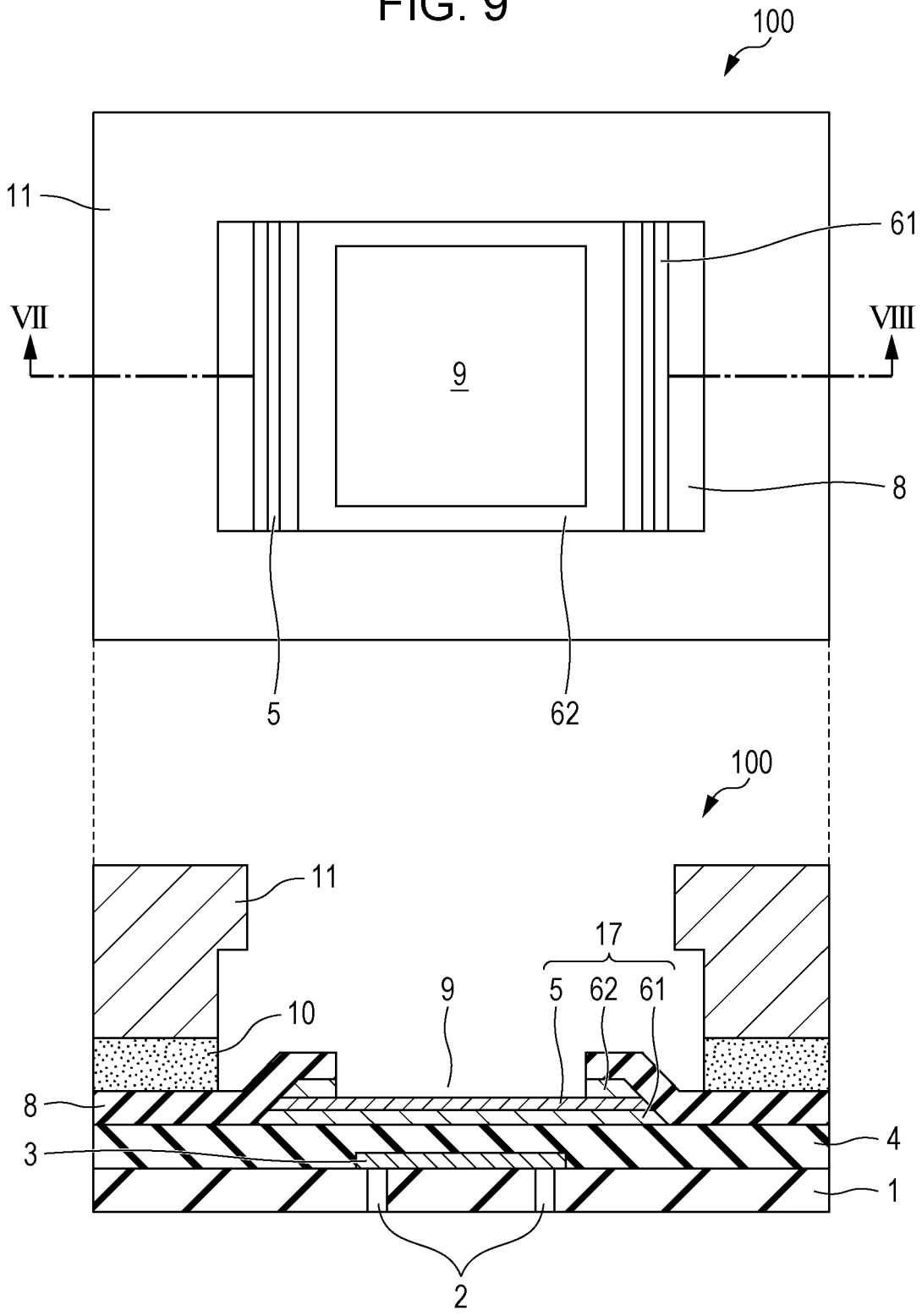
FIG. 9 is a schematic diagram of an example of a part of a liquid discharge head substrate according to Embodiment 4.

Next, as shown in FIG. 8C, the mask 7 is removed using asking and a chemical solution. Next, as shown in FIG. 9, a silicon carbide film is formed as the insulating layer 8 covering the edge portion of the conductive layer 17, for example, by the CVD method. Here, an example of using a silicon carbide film is shown, but a silicon carbonitride film or the like may be used. Since the edge portion of the conductive layer having the three layers of the conductive layer 61, the conductive layer 5, and the conductive layer 62 has a tapered shape, the coatability of the insulating layer 8 with respect to the edge portion of the conductive layer 17 is good.

Next, in the bubble generating region 9, the insulating layer 8 is removed to expose the conductive layer 62, and as shown in FIG. 6, the nozzle member 11 is bonded to the insulating layer 8 with the adhesive layer 10 interposed therebetween to form a liquid discharge head.

Embodiment 4

This embodiment will be described with reference to FIG. 9. Description of parts and effects having the same configuration and function as in Embodiments 1 to 3 will be omitted. This embodiment differs from Embodiment 3 in that the conductive layer 62 has an opening.

In FIG. 9, the conductive layer 17 having three layers of the conductive layer 61, the conductive layer 5, and the conductive layer 62 is formed on the heat generating resistive element 3 with the insulating layer 4 interposed therebetween. The edge portions of the conductive layer 61, the conductive layer 5, the conductive layer 62, and the insulating layer 4 are covered by the insulating layer 8, and the edge portions of the conductive layer 61, the conductive layer 5, and the conductive layer 62 have a tapered shape. Therefore, the coatability of the insulating layer 8 with respect to the edge portion of the conductive layer 17 is good, and penetration of ink through a part of the insulating layer 8 corresponding to the edge portion of the conductive layer 17 can be significantly suppressed.

The insulating layer 8 covering the edge portion of the conductive layer 17 has an opening in the bubble generating region 9, the conductive layer 62 in the opening is removed, and the conductive layer 5 is exposed. Since the conductive layer 5 is exposed in the bubble generating region 9, that is, in the opening of the insulating layer 8, the efficiency of transferring the thermal energy generated in the heat generating resistive element 3 to the ink can be improved. The conductive layer 62 may function as wiring. Therefore, the conductive layer 62 may be disposed in a region other than the region where the insulating layer 8 is opened. A nozzle member 11 is bonded to the insulating layer 8 with an adhesive layer 10 interposed therebetween. For example, an organic layer can be used as the adhesive layer 10.

The liquid discharge head substrate of this embodiment can be manufactured in substantially the same manner as in Embodiment 3. In this embodiment, when removing the insulating layer 8 in the bubble generating region 9, the conductive layer 62 is also removed at the same time to expose the conductive layer 5. Alternatively, after removal of the insulating layer 8 in the bubble generating region 9, the conductive layer 62 in the insulating layer 8 may be removed by changing conditions to suit the removal of the conductive layer 6.

Also in the liquid discharge head substrate 100 described in this embodiment, since the edge portion of the conductive layer 17 has a tapered shape, the coatability of the insulating layer 8 with respect to the edge portion of the conductive layer 17 can be improved. Therefore, the liquid discharge head substrate 100 with improved reliability can be obtained.

Embodiment 5

With reference to FIG. 10, an example in which the above-described liquid discharge head substrate is mounted on a liquid discharge apparatus will be described by example of an ink jet recording type. However, the liquid discharge apparatus is not limited to this type, and the same applies to a liquid discharge apparatus of a thermal transfer type such as a fusion type or sublimation type, for example. The liquid discharge apparatus may be, for example, a single function printer having only a recording function, or may be a multifunction printer having a plurality of functions such as a recording function, a FAX function, a scanner function, and the like. Further, the liquid discharge apparatus may be, for example, a manufacturing apparatus for manufacturing a color filter, an electronic apparatus, an optical apparatus, a microstructure, or the like by a predetermined recording method.

"Recording" may include not only a case of forming an image, a pattern, a structure, or the like that is visualized so that it can be perceived visually by a human being, on a recording medium but also a case of processing a medium. "Recording medium" may include not only paper used in a general liquid discharge apparatus but also those to which a recording agent can be attached such as cloth, plastic film, metal plate, glass, ceramics, resin, wood, leather, etc. "Recording agent" may include not only a liquid such as ink that can be used for formation of images, patterns, etc., or processing of a recording medium by being attached to a recording medium, but also a liquid that can be used for treatment of a recording agent (for example, coagulation or insolubilization of the coloring agent contained in a recording agent).

Figure 10A:
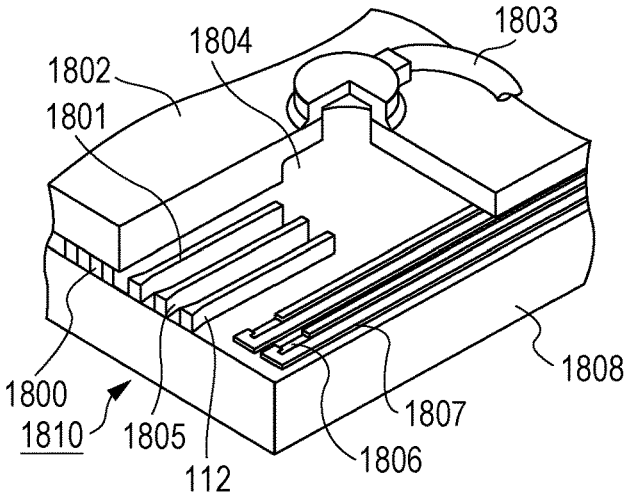
FIGS. 10A to 10D are diagrams illustrating an example of a liquid discharge head and a liquid discharge apparatus.

FIG. 10A shows a main part of a liquid discharge head 1810. The liquid discharge head 1810 includes an ink supply port 1803. The heater Rh of the above-described embodiment is shown as a heat generating portion 1806. As shown in FIG. 10A, by attaching flow path wall members 1801 for forming liquid paths 1805 communicating with a plurality of discharge ports 1800, and a top plate 1802 having an ink supply port 1803 to a base body 1808, the liquid discharge head 1810 can be constructed. In this case, ink injected through the ink supply port 1803 is stored in the internal common liquid chamber 1804 and supplied to each liquid path 1805. By driving the base body 1808 and the heat generating portion 1806 in this state, ink is discharged from the discharge ports 1800.

Figure 10B:
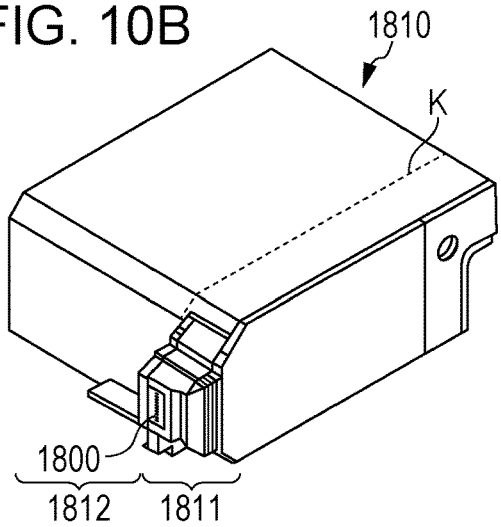

FIG. 10B is a view showing the entire configuration of such a liquid discharge head 1810. The liquid discharge head 1810 includes a recording unit 1811 having the above-described discharge ports 1800 and the liquid discharge head substrate 100 according to any of Embodiments 1 and 4, and an ink container 1812 that holds ink to be supplied to the recording unit 1811. The ink container 1812 is detachably attached to the recording unit 1811 with the line K as the border. The liquid discharge head 1810 is provided with an electrical contact (not shown) for receiving an electric signal from the carriage side when mounted on the liquid discharge apparatus shown in FIG. 10C. On the basis of this electric signal, the heat generating portion 1806 generates heat. Inside the ink container 1812, a fibrous or porous ink absorber is provided to hold the ink, and the ink is held by the ink absorber.

The liquid discharge head 1810 shown in FIG. 10B is mounted on the main body of the ink jet type liquid discharge apparatus, and the signal applied from the main body to the liquid discharge head 1810 is controlled. With such a configuration, it is possible to provide an ink jet type liquid discharge apparatus capable of achieving high-speed recording and high image quality recording.

Hereinafter, an ink jet type liquid discharge apparatus employing such a liquid discharge head 1810 will be described.

Figure 10C:
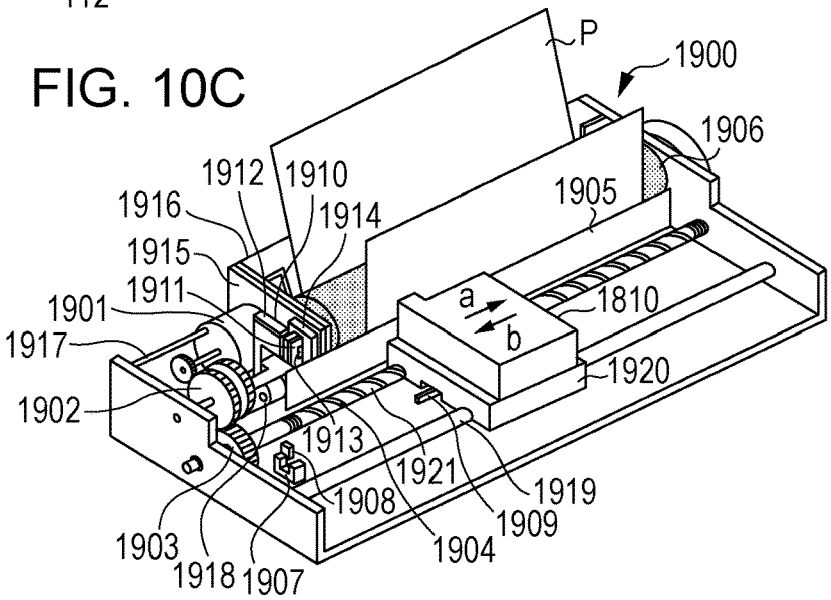

FIG. 10C is an external perspective view showing an ink jet type liquid discharge apparatus 1900 according to an embodiment of the present disclosure. In FIG. 10C, the liquid discharge head 1810 is mounted on a carriage 1920 that is engaged with a helical groove 1921 of a lead screw 1904 that rotates via driving force transmission gears 1902 and 1903 in conjunction with forward and reverse rotation of a drive motor 1901. With such a configuration, the liquid discharge head 1810 can be reciprocated in the direction of arrow a or b along a guide 1919 together with the carriage 1920 by the driving force of the drive motor 1901. A paper press plate 1905 for the recording paper P conveyed onto a platen 1906 by a recording medium feeder (not shown) presses the recording paper P against the platen 1906 along the carriage moving direction.

Photo couplers 1907 and 1908 are home position detectors for confirming the existence of a lever 1909 provided in the carriage 1920 in the region where the photo couplers 1907 and 1908 are provided and switching the rotation direction of the drive motor 1901. A support member 1910 supports a cap member 1911 that caps the entire surface of the liquid discharge head 1810, and a suction unit 1912 sucks the inside of the cap member 1911 to perform suction recovery of the liquid discharge head 1810 through an opening 1913 in the cap. A moving member 1915 enables a cleaning blade 1914 to move in the forward and backward directions, and the cleaning blade 1914 and the moving member 1915 are supported by a main body supporting plate 1916. Instead of the illustrated type of cleaning blade 1914, a well-known cleaning blade may be applied to this embodiment. A lever 1917 is provided for starting the suction of suction recovery and moves along with the movement of a cam 1918 that is engaged with the carriage 1920, and the driving force from the drive motor 1901 is controlled to be moved by a known transmission unit such as a clutch. A recording control unit (not shown) that supplies a signal to a heat generating portion 1806 provided in the liquid discharge head 1810 and governs drive control of each mechanism such as the drive motor 1901 is provided on the apparatus main body side.

In the ink jet type liquid discharge apparatus 1900 having the above-described configuration, the liquid discharge head 1810 performs recording on recording paper P conveyed onto the platen 1906 by the recording medium feeding apparatus while reciprocating over the entire width of the recording paper P. Since the liquid discharge head 1810 employs the liquid discharge substrate of the above-described embodiment, it is possible to achieve both improvement in ink discharge accuracy and drive at low voltage.

Figure 10D:
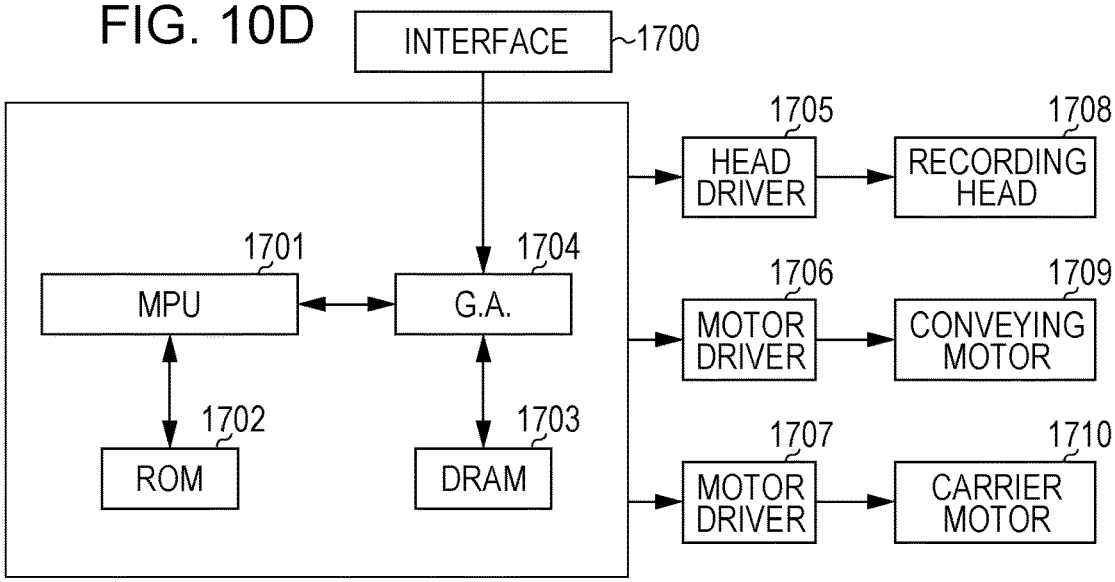

Next, the configuration of a control circuit for performing the recording control of the above-described apparatus will be described. FIG. 10D is a block diagram showing the configuration of the control circuit of the ink jet type liquid discharge apparatus 1900. The control circuit includes an interface 1700 to which a recording signal is input, an MPU (microprocessor) 1701, a program ROM 1702, a dynamic RAM (random access memory) 1703, and a gate array 1704. The program ROM 1702 stores a control program executed by the MPU 1701. The dynamic RAM 1703 stores various data such as the recording signal and recording data to be supplied to the head. The gate array 1704 controls supply of recording data to a recording head 1708. The gate array 1704 also controls data transfer between the interface 1700, the MPU 1701, and the RAM 1703. The control circuit further includes a carrier motor 1710 for conveying the recording head 1708 and a conveying motor 1709 for conveying the recording paper. The control circuit also includes a head driver 1705 for driving the recording head 1708, and motor drivers 1706 and 1707 for driving the conveying motor 1709 and the carrier motor 1710, respectively.

Describing the operation of the control configuration, when a recording signal is input to the interface 1700, the recording signal is converted into recording data for printing between the gate array 1704 and the MPU 1701. Then, the motor drivers 1706 and 1707 are driven, and the recording head is driven in accordance with the recording data sent to the head driver 1705 to perform printing.

The liquid discharge apparatus can also be used as an apparatus having 3D data and forming a three-dimensional image.

Embodiment 6

Another embodiment according to the present disclosure is a method for forming a conductive layer comprising the steps of forming a first film containing iridium; forming a second film containing a metal different from iridium on the first film; disposing a processed substrate including the first film and the second film in an etching apparatus having a first electrode and a second electrode such that the first film is disposed on the first electrode side and the second film is disposed on the second electrode side; etching a part of the second film; and after etching the second film, etching a part of the first film, wherein in the step of etching a part of the second film, in the etching apparatus, of the first electrode and the second electrode disposed with the first film and the second film interposed therebetween, the amount of high-frequency power applied to the second electrode located on the second film side is larger than the amount of high-frequency power applied to the first electrode located on the first film side, and wherein in the step of etching a part of the first film, in the etching apparatus, the amount of high-frequency power applied to the first electrode is larger than the amount of high-frequency power applied to the second electrode.

While the present disclosure has described exemplary embodiments, it is to be understood that the claims are not limited to the disclosed exemplary embodiments. The scope of the following claims is to be accorded the broadest interpretation so as to encompass all such modifications and equivalent structures and functions.

This application claims the benefit of Japanese Patent Application No. 2017-127977, filed Jun. 29, 2017, which is hereby incorporated by reference herein in its entirety.

What is claimed is:

1. A liquid discharge head substrate comprising:

at least one heat generating resistive element;

a first insulating layer covering the heat generating resistive element;

a conductive layer disposed on the first insulating layer and overlapping the heat generating resistive element with the first insulating layer interposed therebetween in a plan view with respect to an upper surface of the heat generating resistive element; and a second insulating layer covering an edge of the conductive layer, wherein in a cross-section passing through the heat generating resistive element, the second insulating layer, and the conductive layer, the angle formed by a side surface of the edge of the conductive layer and a bottom surface of the conductive layer is an acute angle, wherein the conductive layer includes an iridium layer and a first tantalum layer disposed on the iridium layer, and wherein the first tantalum layer has an opening in a region that overlaps with the heat generating resistive element in the plan view.

2. The liquid discharge head substrate according to claim 1, wherein the conductive layer includes an iridium layer.

3. The liquid discharge head substrate according to claim 1, wherein the second insulating layer contains at least one of silicon carbide and silicon carbonitride.

4. The liquid discharge head substrate according to claim 1, wherein a nozzle member is disposed on the second insulating layer with an adhesive layer interposed therebetween, and wherein a part of the nozzle member that is bonded to the second insulating layer surrounds the conductive layer in the plan view.

5. The liquid discharge head substrate according to claim 1, wherein a liquid discharge element has the at least one heat generating resistive element and the conductive layer, and wherein the at least one heat generating resistive element comprises a plurality of heat generating resistive elements.

6. A liquid discharge head comprising:

a recording unit having the liquid discharge head substrate according to claim 5, and a plurality of discharge ports disposed so as to correspond to the respective ones of the plurality of heat generating resistive elements of the liquid discharge head substrate; and an ink container attached to the recording unit.

7. A liquid discharge apparatus comprising:

the liquid discharge head according to claim 6;

a carriage on which the liquid discharge head is mounted; and a guide for moving the carriage.

8. A liquid discharge head substrate comprising:

at least one heat generating resistive element;

a first insulating layer covering the heat generating resistive element;

a conductive layer disposed on the first insulating layer and overlapping the heat generating resistive element with the first insulating layer interposed therebetween in a plan view with respect to an upper surface of the heat generating resistive element; and a second insulating layer covering an edge of the conductive layer, wherein in a cross-section passing through the heat generating resistive element, the second insulating layer, and the conductive layer, the angle formed by a side surface of the edge of the conductive layer and a bottom surface of the conductive layer is an acute angle, wherein the conductive layer includes an iridium layer and a first tantalum layer disposed on the iridium layer, wherein the conductive layer has a second tantalum layer, and wherein the iridium layer is disposed on the second tantalum layer.

9. A method for forming a conductive layer comprising:

forming a first film containing iridium;

forming a second film containing a metal different from iridium on the first film containing iridium;

etching a part of the second film by isotropical etching;

after etching the second film, etching a part of the first film by anisotropical etching; and disposing a processed substrate including the first film and the second film in an etching apparatus having a first electrode and a second electrode such that the first film is disposed on the first electrode side and the second film is disposed on the second electrode side, wherein in the etching a part of the second film, in the etching apparatus, the amount of high-frequency power applied to the second electrode is made larger than the amount of high-frequency power applied to the first electrode, and wherein in the etching a part of the first film, in the etching apparatus, the amount of high-frequency power applied to the first electrode is made larger than the amount of high-frequency power applied to the second electrode.

10. The method for forming a conductive layer according to claim 9, wherein a saturated vapor pressure of the reaction product between gas introduced in the etching a part of the second film and the first film is lower than a saturated vapor pressure of the reaction product between the gas and the second film.

11. The method for forming a conductive layer according to claim 9, further comprising:

before etching a part of the second film, forming a resist film on the second film; and after etching the first film, removing the resist film.

12. The method for forming a conductive layer according to claim 9, further comprising:

before forming the first film, forming a third film containing the metal, wherein the first film is formed on the third film.

13. The method for forming a conductive layer according to claim 12, further comprising:

after the etching the first film, etching the third film by anisotropic etching.

14. The method for forming a conductive layer according to claim 9, wherein in the etching a part of the second film, $Cl_2$ gas and $BCl_3$ gas are introduced into the etching apparatus.

15. The method for forming a conductive layer according to claim 9, wherein in the etching a part of the film containing iridium, Ar gas is introduced into the etching apparatus.

16. The method for forming a conductive layer according to claim 9, wherein in the etching a part of the first film, the second film after being etched is further etched, and an edge of the second film recedes in a direction in which an area of the second film after being etched in a plan view with respect to a surface of the first film on which the second film is formed decreases.

17. A method for manufacturing a liquid discharge head substrate comprising the steps of:

before forming the first film, forming a heat generating resistive element;

forming a first insulating layer covering the heat generating resistive element; and forming a second insulating layer covering an edge of a conductive layer formed by the method for forming a conductive layer according to claim 9, wherein the conductive layer is formed on the first insulating layer.

* * * * *